United States Patent [19]

Ellis

[11] 4,116,330

[45] Sep. 26, 1978

[54] COMBINATION PACKAGE AND DISPLAY CASE

[75] Inventor: A. Barry Ellis, Glen Ellyn, Ill.

[73] Assignee: Azteca Corn Products Corporation, Chicago, Ill.

[21] Appl. No.: 828,494

[22] Filed: Aug. 29, 1977

[51] Int. Cl.[2] ..... B65D 5/54

[52] U.S. Cl. ..... 206/44 R; 206/45.12; 206/634; 229/160; 229/28 R

[58] Field of Search ..... 206/44 R, 44.11, 44.12, 206/45, 45.11, 45.12, 45.13, 45.29, 806, 602, 606, 634; 229/160, 28 R; 248/307, 205 A; 85/84

[56] References Cited

U.S. PATENT DOCUMENTS

| | | | |
|---|---|---|---|
| 1,414,062 | 4/1922 | Arnold | 206/44 R |
| 3,190,439 | 6/1965 | Parker | 206/45 |
| 3,193,231 | 7/1965 | Curry | 248/205 A |
| 3,210,030 | 10/1965 | Ramsey et al. | 248/73 |
| 3,217,436 | 11/1965 | Van Wormer | 206/45 |
| 3,227,266 | 1/1966 | Soma | 206/44 R |
| 3,297,290 | 1/1967 | Patterson | 248/307 |
| 3,347,356 | 10/1967 | Kossnar | 206/45.29 |
| 3,687,278 | 8/1972 | Graham et al. | 206/44 R |
| 3,990,752 | 11/1976 | Hoffman et al. | 206/44 R |
| 4,016,977 | 4/1977 | Krautsack | 248/205 A |
| 4,053,101 | 10/1977 | Hart, Jr. | 229/36 |
| 4,058,206 | 11/1977 | Morse | 206/44 R |

*Primary Examiner*—William Price
*Assistant Examiner*—Bruce H. Bernstein
*Attorney, Agent, or Firm*—Robert E. Wagner; Gerald T. Shekleton

[57] ABSTRACT

A package for the shipping of prepackaged foodstuffs and the like which is convertible into either of two display units by the selective removal of package portions, one display unit featuring the display of multiple facings of the prepackaged foodstuffs and the other featuring the display of one facing of the prepackaged foodstuffs. The multiple facing display unit may be attached to a shelf rail as a shelf extender by appropriate fastening means.

1 Claim, 12 Drawing Figures

FIG. 1
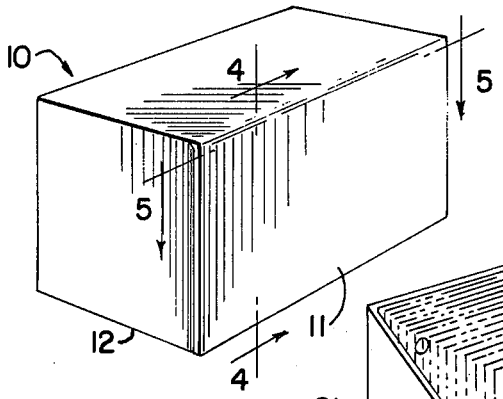
FIG. 2
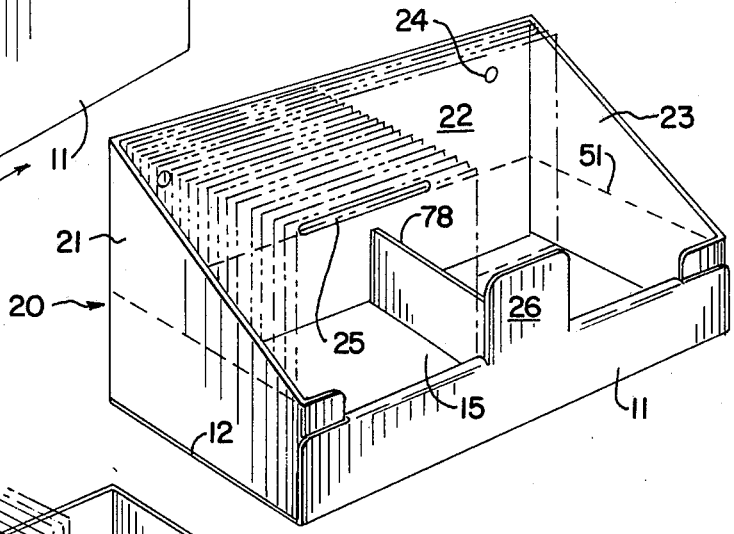
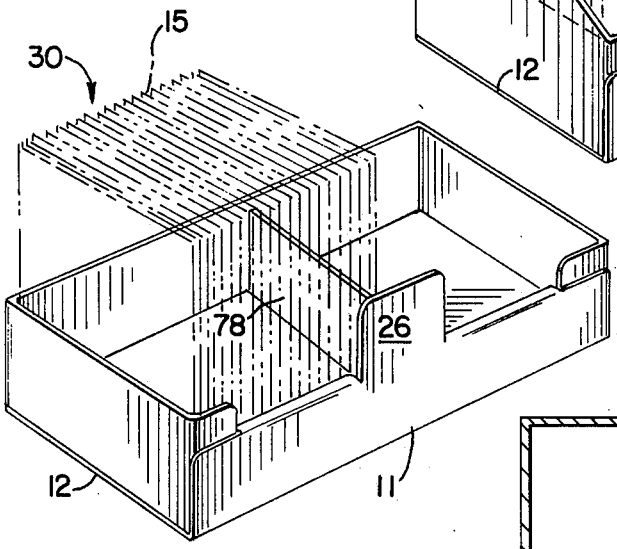
FIG. 3
FIG. 4
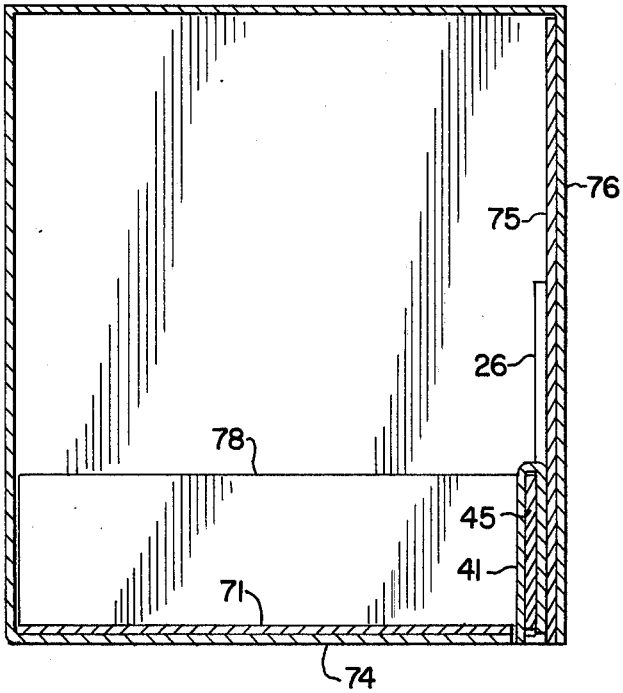

COMBINATION PACKAGE AND DISPLAY CASE

This application relates in general to packaging and specifically to a shipping package adapted for conversion into a display package for the attractive display of the prepackaged items in the store.

The merchandising of seasoning and sauce mixes in grocery stores is often accomplished with foil packages, generally of a flat rectangular shape. These individual packages are brightly colored and attractively designed in an effort to catch the consumer's eye on walking past the display of such packages. The manner of the display of such articles is generally a major factor in their sales. It has thus become a practice in the packaging art to provide an attractive display case for placement on the grocery shelves.

These display cases serve two general purposes. One purpose is to segregate the respective spice and sauce mixes by content and brand name, while another important function is to aid in attracting the consumer's attention to a particular brand. These display cases may be provided within the original shipping container for holding the individual packages. However, as is more often the case, the original shipping container will also double as a display case, being convertible to the aprpopriate shape by the use of various proprietary methods. However, the use of either of these display packages is self-limiting in that only one manner of display is allowed for any given display case. Therefore, when a grocer does not have the shelf space to accommodate the traditional or contemplated type of display, he may be forced to either discard the provided display case and display the packages in some other manner, or if the grocer chooses to use the display case, any advantages normally gained through that use would be lost through the placement of the display case in a manner not utilizing its best features for the attraction of the consumer's attention.

SUMMARY OF THE INVENTION

These problems of the prior art are obviated by the package display case of the subject invention wherein the original container in which the packages are shipped to the store are easily convertible for display of the packages in several different eye-catching manners. The container of the subject invention initially presents a rectangular box when used as a shipping container for transporting the packages to the point of purchase. The grocer or grocery clerk, when stocking and pricing the individual packages for display on the grocer's shelf, after opening the box and marking each individual package with the price, if such is the practice in that particular store, may convert the box to the particular type of display carton which he wishes to use. The grocer may wish to have two facings of the package on display or just one. The considerations taken into account in making such a determination would predominantly be the size of the shelf spacing in which the packages are to be displayed. For a shelf of small width, a two-facing display caton, i.e., one displaying the fronts of two packages side by side, would be preferable. If, however, one wishes to display a large number of mixes of different contents and brand names adjacent one another and sufficient shelf space is not available, a single-facing display, i.e., one showing the front of only one package, would be more appropriate. To achieve a two-facing display upon opening of the box, the upper cover portion may be torn off along a perforated line provided for that purpose. The resulting display container will provide an attractive and eye-catching display of a double row or facing of the mix packages. A divider strip in the container assures separation and optimal display of each package facing. Spaced eyelets or apertures are located on the upper rear wall of the two-facing display package and may be used with plastic arrows or other fastening devices to secure the display to the shelf or price rail at the periphery of the shelf. Similarly, an open slot is also provided on the rear wall of the open display package which will accept a clip or similar fastening device for attachment to the shelf rail.

If the grocer does not have room for presenting the two-facings of the packages, he may convert to a single-facing display embodiment of the subject invention by tearing along a second, lower, perforated line, similar to the first line of perforations. Mix packages are then placed in the display facing one direction. When used in this manner, the divider strip will aid in keeping the packages upright. The display package may then be placed on a shelf in a minimum amount of shelf front space and yet present an adequate display facing to the consumer. The adaptability of the display package to the different modes of display extends the scope of its use beyond mere shelf display to other areas of the grocery store, including the meat counter, dairy case or in special promotional displays. This adaptability is accomplished without the use of expensive external stands or the like, and requires merely a hook or other attaching device such as a plastic arrow when in use as a shelf extender. Each shipping container then becomes a self-enclosed multi-purpose display tray which may be adapted to fulfill the changing needs of a grocery store display case.

An object of the subject invention is therefore a shipping container which may be used as a display container for the attractive display of packages contained within.

A further object of the subject invention is a display package which may be used as either a two-facing display package or a single-facing display package.

A further object of the subject invention is a two-facing display package which is adaptable to be hung on a shelf rail as a shelf extender.

A still further object of the subject invention is a display package which may be adapted to conform to the grocers available shelf space.

Further objects of the invention, together with additional features contributing thereto and advantages accruing therefrom, will be apparent from the following description of one embodiment of the subject invention when read in conjunction with the accompanying drawings wherein:

FIG. 1 is a perspective view of one embodiment of the subject invention;

FIG. 2 is a perspective view of a two-facing display unit;

FIG. 3 is a perspective view of a one-facing display unit;

FIG. 4 is a cross section taken along the line 4—4 of FIG. 1.

Figure 5:
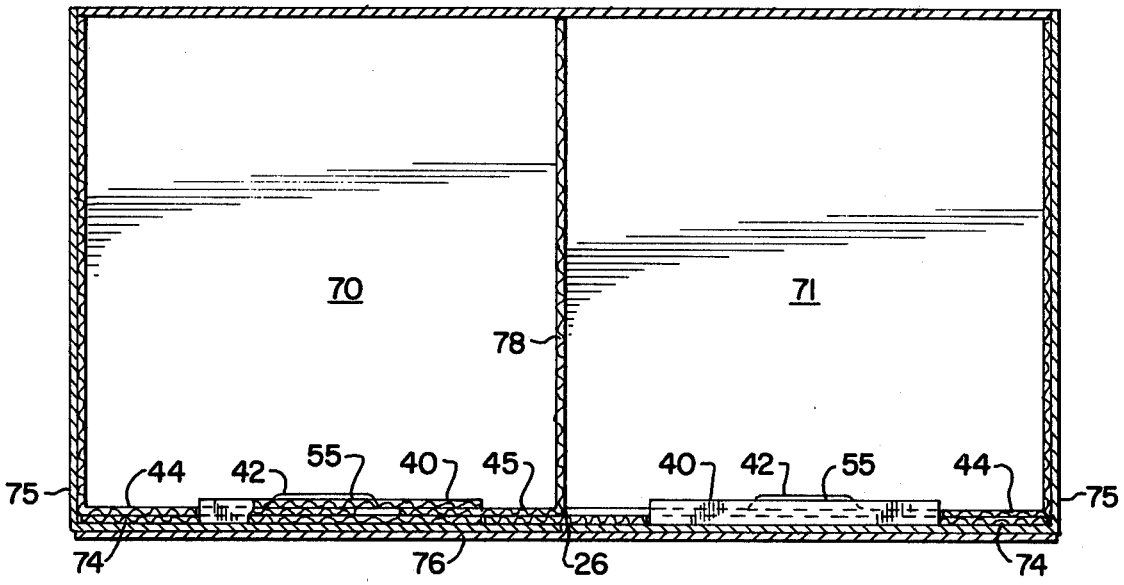
FIG. 5 is a cross section taken along the line 5—5 of FIG. 1.

Referring now to FIG. 1 there is shown the shipping container 10, according to one embodiment of the subject invention, in which mix packages for seasoning and sauces may be transported from a processing or packaging plant to the point of purchase. A plurality of typical mix packages 15 are shown in relief in the two-facing display package 20 of FIG. 2 and the single-facing display package 30 of FIG. 3. It is preferable that the size of a single mix package 15 be so related to the dimensions of the shipping container 10 that the width of the mix package 15 is equivalent or slightly less than the width 12 of the shipping container 10. Further, it is preferable, in one embodiment of the subject invention, that the length 11 of the shipping container 10 be roughly equivalent to twice the width 12. In this manner, the mix packages 15 may be initially shipped facing the width 12 and when the shipping container is opened, as will be described below, and the packages are priced by a grocery clerk, they may be placed in the display package 20 for displaying two facings of the packages 15 in display carton 20 or one facing of mix packages 15 in display carton 30 of FIG. 3, dependent upon the considerations to be discussed below. Of course, the length may be any integral multiple of the width, dependent on the number of facings of packages desired to be displayed. While mix packages are shown and described as used in one embodiment of the invention, it should be understood that any package capable of such display may be used with the subject invention.

The shipping package 10 is received by the grocer in a closed condition as depicted in FIG. 1. This closure is effected by the use of staples, tape, glue or the like for keeping the package 10 in a closed conformation and retaining the integrity of the mix packages 15 within. Upon opening a shipping container 10 for pricing and the like, the container is in the form shown in FIG. 2, with the addition of flaps 75, 76 and 77 (shown in FIG. 6) above the perforated line 50. After the mix packages 15 are removed for pricing, the grocery clerk may shape the box to the configuration desired. To construct the double-facing display unit of FIG. 3, he merely tears along perforated line 50 and discards the upper flap portions 75, 76 and 77.

Figure 9:
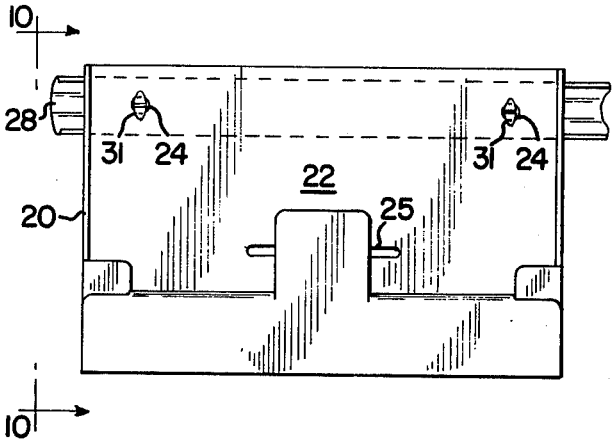
FIG. 9 is a front view of the display unit of the subject invention fastened to a shelf rail using the fastener of FIG. 7.
Figure 10:
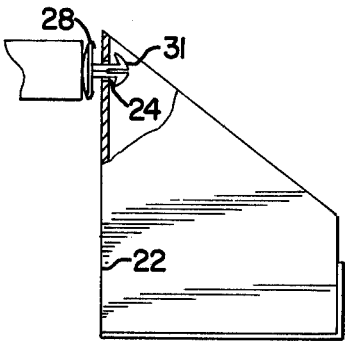
FIG. 10 is a cross section taken along the lines 10—10 of FIG. 9, showing the extension of the fastener through the display unit for fastening the display unit to the shelf rail.
Figure 11:
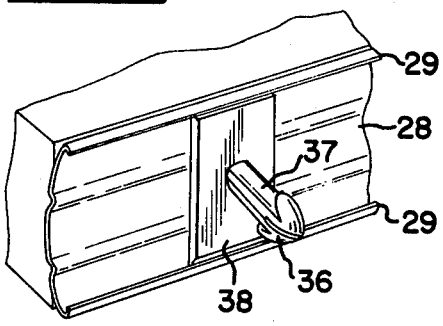
FIG. 11 is a perspective view of the fastener of FIG. 7 as attached to a shelf rail; and, FIG. 12 is a rear perspective view of the fastener of FIG. 7 showing the adhesive and removable backing.
Figure 7:
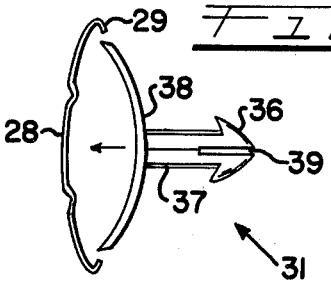
FIG. 7 is a side view of the fastener used in attaching the display unit of the subject invention to a shelf rail.

If one desires to use the display unit 20 as a shelf extender, that is, highlight the packages of the display unit by attaching them to the shelf rail 50 so they extend out from the shelf and over the aisle, fastening means, or plastic "arrows" 31 (FIGS. 7 and 11) may be provided to secure the display unit 20 though the openings 24 in the back 22 of the display (FIGS. 9 and 10). The plastic arrows 31 which are used to fasten the display unit 20 to a common shelf or price rail 28 have a head 36, which is preferably arrow-shaped in cross section. The head 36 is at one end of a stem 37, the opposing end terminating in a transverse arcuate base portion 38. The stem may have a longitudinally extending slot 39 which is open-ended at the head 36 and closed at a point spaced from the base 38, thus making the arrow self-locking. The arrow 31 is secured in the shelf rail 28 by securing opposite ends of the base under the lips 29 of the shelf rail 28. To use the display unit 20 as a shelf extender, the arrows 31 are compressed by squeezing the arrow head 36 and decreasing the slot width and head size. This is accomplished by pressing display unit 20 against the prepositioned arrows 31 so the arrows "pop" into the openings 24 in the display unit 20 (FIG. 10).

Figure 8:
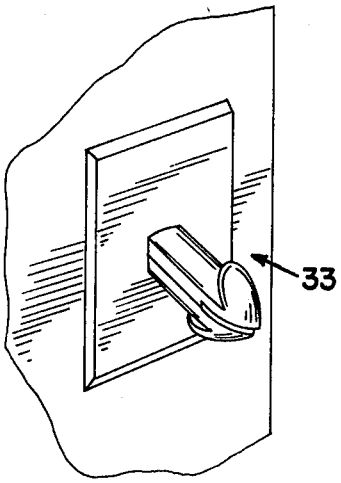
FIG. 8 is a perspective view of another embodiment of a fastener for attaching the display unit of the subject invention to a flat vertical surface.
Figure 12:
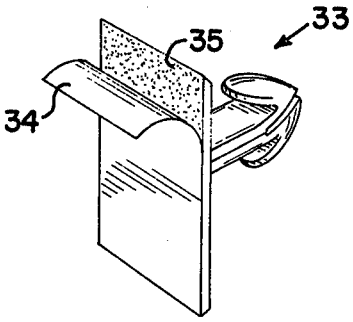

Should one wish to hang the display unit 20 on a flat wall or the like, an arrow 33 as shown in FIGS. 8 and 12 may be used, having an adhesive backing 35 which is readied for use by peeling off protective covering 34. Arrows 33 may then be placed on a vertical flat surface and the display unit 20 secured thereto as described above. Support clips (not shown) may also be used in conjunction with slot 25 to support the display unit 20 on the shelf rail as a shelf extender.

For achieving the single facing display unit 30 of FIG. 3, flaps 21, 22 and 23 are torn off along perforated line 51. The mix packages 15 may then be replaced in a vertical attitude in the display unit as either a double facing placement orienting the front of a package 15 along the length 11, for use with display unit 20, or a single facing placement, orienting the front of packages 15 along the width 12, for use with display unit 30. The display units are then placed along the shelves in the appropriate manner for sale.

Figure 6:
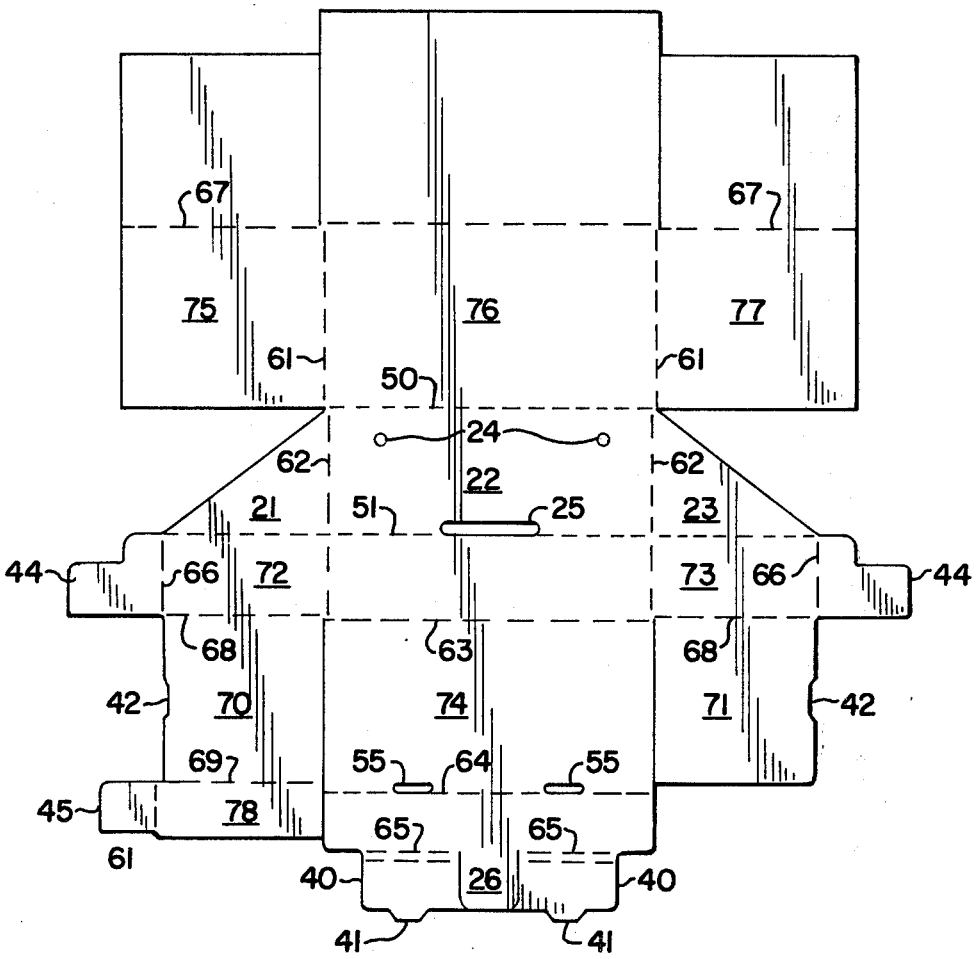
FIG. 6 is a top plan view of a blank used for forming the boxes of the subject invention.

The container 10 is constructed from a single sheet of material shown in FIG. 6 by folding along the lines of various creases or folds shown in dotted line. By virtue of the various slots and tabs, the box, with the exception of the final closure, needs no fastening devices such as glue, staples, or the like, and may be easily assembled by hand in a manner to be described.

The container blank shown in FIG. 6 comprises two major portions, a top, substantially rectangular portion, joined to a middle trapezoidal portion which is itself joined to a lower, substantially rectangular portion. The upper blank portion has three flap sections 75, 76 and 77, the upper parts of which are distinct and not connected to one another, each being foldable on crease line 67. In addition, the flap portion 75 and 77 are foldable inwardly on crease line 61. The entire upper flap section is connected to the middle trapezoidal section and foldable along perforated line 50. The upper section may be removed from the lower section through tearing along the perforated line 50. The middle section 22 is connected to the lower blank section by a similar perforated line 51 and may be removed from the lower blank section in a similar tearing fashion. The lower blank section comprises three flaps 70, 71 and 74 which are distinct from one another and each foldable along crease line 68. Flap portion 72 and 73 are foldable along crease line 62 and have flaps 44 which are each foldable along crease line 66. On the lower portion of flap 70 is a foldable rectangular portion 78 which itself has a flap 45 foldable along lines 61. The lower portion of flap 74 has a portion foldable along crease line 64. Flaps 40 on the lower portion of flap 74 are foldable along double crease line 65 to achieve a 180 degree turn in the flap. Tabs 41 are located on each of the lower perforated flaps 40. Indentations 42 are found on the mid portion of flaps 70 and 71.

The manner of construction of a container 10 is as follows: flaps 70 and 71 are folded along crease line 68. Similarly, flaps 72 and 73 are folded along crease line 62, thereby bringing flaps 70 and 71 into contact with one another. The end portion of flap 70 is folded on crease line 69 and tab portion 45 is folded along crease line 61. Flap 74 is then folded along crease line 63. Flaps 44 are folded along crease lines 66 and the upper portion of flap 74 is folded along crease line 64. Flaps 40 are folded along double crease lines 65 thereby achieving a 180 degree turn in flaps 40. The tabs 41 on flaps 40 are then placed over flaps 44 and secured into slots 55. Indentations 42 in flaps 70 and 71 allow the insertion of the tabs 41 into the slots 55 in such a manner that the flaps 40 secure flaps 70 and 71 to the base of the display container and simultaneously engage tab portion 45 to retain end portion 78 in the center of the display unit as a divider strip. Flap 26 is thus left in an upstanding position in the front of display units 20 and 30. This central position makes possible an attractive and eye-catching use of the company logo, brand name or trademark associated with the product being sold.

The cross sections of FIGS. 4 and 5 bring out the manner of retention of flaps 44 by flap 40. Further, it can be seen in FIG. 5 that tab 41 is inserted through detention 42 into slot 55, thereby retaining flaps 70 and 71 in a horizontal position. The partial cut-away view of flap 40 in FIG. 5 shows that flaps 44 and 45 are securely retained by the folded flap 40.

To close the container for shipping purposes, each of flaps 75, 76 and 77 are folded along crease lines 67 and 61, respectively, and then the entire upper unit is folded along perforated line 50 over the display unit and fastened in place as described above to form the shipping container 10 of FIG. 1.

While the invention has been described with reference to a preferred embodiment, it will be understood by those skilled in the art that various changes may be made and equivalents may be substituted for elements thereof without departing from the scope of the invention. In addition, many modifications may be made to adapt a particular situtation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. A four sided shipping container for the distribution and shelf display of prepackaged articles having a display face, said shipping container being formed from a single piece blank and having a cover, said cover enclosing a base portion having a lower base portion with substantially equal wall height and an upper base portion open on one side and of a certain greater uniform height on an opposed side, each of the other two sides comprising connecting sides uniformly rising in height from said open side to said opposing side, said shipping container having perforations detachably defining said cover, said upper base portion and said lower base portion, and being convertible from a first structure for completely enclosing said prepackaged articles for shipment, to a second structure by the removal of said cover from said upper base portion along their connecting perforations, thereby exposing said display face of said prepackaged articles on said open side, said upper base portion substantially concealing said prepackaged articles on the remaining sides, said first structure being convertible to a third structure by the removal of both of said cover and said upper base portion along their respective perforations and said second structure being convertible to said third structure by the removal of said upper base portion along its perforated connection to the lower base, said third structure displaying said prepackaged articles on all sides, each of said second and third structures capable of being formed from said first structure for use in a plurality of shelf conditions, said second structure being for the exposure of the display faces of at least two prepackaged articles for use as desired on shelves allowing for a maximum of display space, and said third structure being for the exposure of the display face of one prepackaged article along one of said connecting sides for use as desired on shelves having a minimum of shelf space.

* * * * *